US007553012B2

(12) United States Patent
Kozaki et al.

(10) Patent No.: US 7,553,012 B2
(45) Date of Patent: Jun. 30, 2009

(54) IMAGE RECORDING APPARATUS

(75) Inventors: Daisuke Kozaki, Nagoya (JP); Masahiko Sasa, Nagoya (JP); Kiyoshi Ueda, Anjo (JP)

(73) Assignee: Brother Kogyo Kabushiki Kaisha (JP)

( * ) Notice: Subject to any disclaimer, the term of this patent is extended or adjusted under 35 U.S.C. 154(b) by 552 days.

(21) Appl. No.: 11/242,794

(22) Filed: Oct. 5, 2005

(65) Prior Publication Data

US 2006/0076729 A1 Apr. 13, 2006

(30) Foreign Application Priority Data

Oct. 8, 2004 (JP) ..... 2004-296909

(51) Int. Cl.
*B41J 29/13* (2006.01)
*B41J 2/01* (2006.01)

(52) U.S. Cl. ..... 347/108; 347/104

(58) Field of Classification Search ..... 347/104, 347/108, 152, 222; 399/107, 110, 123, 124; 271/162–164, 171; D18/50
See application file for complete search history.

(56) References Cited

U.S. PATENT DOCUMENTS 5,061,961 A * 10/1991 Jacobs et al. ..... 399/116
5,118,093 A * 6/1992 Makiura et al. ..... 271/291
5,382,998 A * 1/1995 Shida et al. ..... 355/50
5,406,316 A * 4/1995 Schwiebert et al. ..... 347/18
6,898,395 B2 * 5/2005 Mui et al. ..... 399/107

FOREIGN PATENT DOCUMENTS

JP 5-64856 8/1993
JP 8-188294 7/1996

* cited by examiner

*Primary Examiner*—Stephen D Meier
*Assistant Examiner*—Geoffrey Mruk
(74) *Attorney, Agent, or Firm*—Banner & Witcoff, Ltd.

(57) ABSTRACT

There is disclosed an image recording apparatus having a lower body portion, an upper body portion, a guide, a first engager disposed in the upper body portion, and a second engager disposed in the guide. The lower body portion includes a curved feed pathway, an image recording device, and a recording medium feeder which feeds one by one a plurality of recording media as stacked, into the feed pathway and toward the image recording device. The upper body portion includes an image reading device which portion is disposed above the lower body portion and openable with respect to the lower body portion by being displaced upward. The guide which defines at least a part of the feed pathway, and is removably placed on the lower body portion. The first engager is engageable with the second engager so as to prevent the guide from coming off of the apparatus at least in a direction to an external side of the apparatus, while the upper body portion is closed with respect to the lower body portion.

20 Claims, 17 Drawing Sheets

IMAGE RECORDING APPARATUS

INCORPORATION BY REFERENCE

The present application is based on Japanese Patent Application No. 2004-296909, filed on Oct. 8, 2004, the content of which is incorporated herein by reference.

BACKGROUND OF THE INVENTION

1. Field of the Invention

The invention relates to an image recording apparatus comprising: a lower body portion such as a mainbody housing incorporating an image recording portion, to which a medium supply cassette accommodating a stack of recording media is detachably attached, so that the recording media is supplied one by one from the medium supply cassette such that a topmost one of the stack of the recording media is separated from the other recording media; an upper body portion such as an upper casing incorporating an image reading device, which is pivotally connected to the lower body portion; and a guide for feeding the recording medium as supplied from the medium supply cassette to the image recording portion along a pathway U-shaped sideways.

2. Description of Related Art

A conventional image recording apparatus, such as copy machine, printer, and facsimile machine, comprises a mainbody housing incorporating an image recording portion and a recording medium feeder including a feeder roller, and an upper casing incorporating an image reading device and disposed on the mainbody housing, as disclosed in JP-A-8-188294 (especially FIGS. 1 and 2). A medium supply cassette accommodating a stack of recording media such as cut paper sheets on which image is to be recorded is detachably attached to a lower portion of the mainbody housing, and the feeder roller of the recording medium feeder is rotated to sequentially separate a topmost one of the recording media stacked in the medium supply cassette from the others to feed the recording media one by one to the image recording portion.

The recording medium feeder disclosed in the above-mentioned is constructed such that the feeder roller is disposed above the medium supply cassette, and a guide which is U-shaped sideways as seen from a lateral side and disposed at the side of an end of the medium supply cassette on the downstream side in a direction of the feeding of recording medium so as to feed each recording medium in the form of a paper sheet or others while U-turning and reversing the recording medium toward an image recording portion disposed above the medium supply cassette to record an image on the recording medium fed thereto. A lower end of the U-turn guide is connected to and supported by a mainbody housing such that the U-turn guide is pivotable about a lateral shaft. When a recording medium is caught around the feeder roller or other places, the U-turn guide is turned toward the external side of the mainbody housing so as to form a wide space between the U-turn guide and the feeder roller.

Since the U-turn guide is pivotably supported only at the lower, proximal end portion thereof, the U-turn guide tends to come off of the mainbody housing when the recording medium having a resistance to being bent presses the U-turn guide while being reversed along the guide. Hence, it is required to dispose a lock mechanism in some form for locking the U-turn guide to the mainbody housing.

Requiring an unlocking mechanism, too, the above-described arrangement where the lock mechanism is provided to lock the U-turn guide to the mainbody housing leads to an increase in the number of components of the apparatus. Where the U-turn guide and the mainbody housing are formed of a synthetic resin, it may be contemplated to form the lock mechanism integrally with at least one of the U-turn guide and the mainbody housing, so as to prevent this problem. However, this complexities the configuration of a mold used for forming the U-turn guide and/or the mainbody housing.

Further, where the lock mechanism is not a well-designed one, the guide rattles every time a recording medium passes along the U-turn guide, thereby deteriorating the stability in the feeding of recording medium, that is, a recording medium may be obliquely fed, or caught to cause a jam.

SUMMARY OF THE INVENTION

This invention has been developed in view of the above-described situations, and it is therefore an object of the invention to provide an image recording apparatus which is simple in structure, has a U-turn guide which does not easily come off, and is capable of feeding a recording medium without suffering from a jam caused by the recording medium caught in the apparatus.

To attain the above object, the invention provides an image recording apparatus comprising a lower body portion, an upper body portion, a guide, a first engager disposed in the upper body portion, and a second engager disposed in the guide. The lower body portion includes a curved feed pathway, an image recording device, and a recording medium feeder which feeds one by one a plurality of recording media as stacked, into the feed pathway and toward the image recording device. The upper body portion includes an image reading device which portion is disposed above the lower body portion and openable with respect to the lower body portion by being displaced upward. The guide which defines at least a part of the feed pathway, and is removably placed on the lower body portion. The first engager is engageable with the second engager so as to prevent the guide from coming off of the apparatus at least in a direction to an external side of the apparatus, while the upper body portion is closed with respect to the lower body portion.

By this arrangement, while the upper body portion is closed with respect to the lower body portion, that is, while the upper body portion is placed adjacent to the lower body portion, the first and second engagers cooperate to prevent the guide disposed in the lower body portion from coming off of the apparatus. That is, while the upper body portion is closed with respect to the lower body portion, the first and second engagers may or may not be held in contact with each other, but at least when the guide is prevented from coming off, the first and second engagers engage, namely, contact each other.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described several presently preferred embodiments of the invention, by referring to the accompanying drawings.

Figure 1:
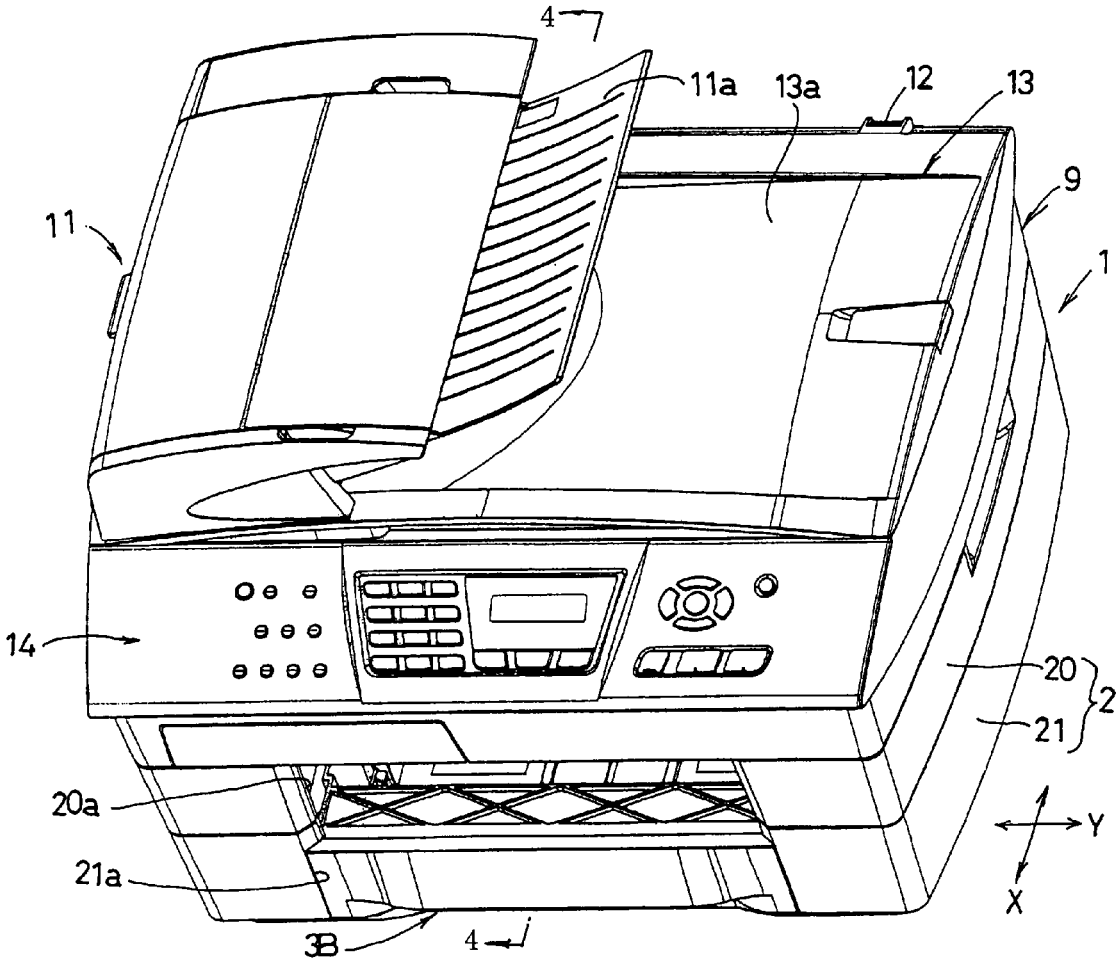
FIG. 1 is a perspective view of an image recording apparatus according to a first embodiment of the invention.

First, referring to FIGS. 1-12, there will be described an image recording apparatus according to a first embodiment of the invention. In FIG. 1, reference numeral 1 generally denotes the image recording apparatus of the first embodiment in the form of a MFD (Multifunction Device), which has at least two of the following functions: printer function, copy function, scanner function, and facsimile function. As shown in FIG. 1, a mainbody housing 2 constituting a lower body portion of the apparatus 1 comprises a first lower casing 20 and a second lower casing 21 connected to the under side of the first lower casing 20.

The apparatus 1 can receive or accommodate two medium supply cassettes, namely, a first medium supply cassette 3A (shown in FIGS. 4 and 6) and a second medium supply cassette 3B disposed below the first medium supply cassette 3A. That is, the first medium supply cassette 3A is removably inserted into the first lower casing 20 of the mainbody housing 2 from a first front opening 20*a* open in a front face of the apparatus 1, which is on the lower side in FIG. 1. The second medium supply cassette 3B is removably inserted in the second lower casing 21 connected to the under side of the first lower casing 20 and disposed at the bottom of the apparatus 1, from a second front opening 21*a* which is also open on the front face of the apparatus 1. FIG. 1 shows the state where the second medium supply cassette 3B is accommodated in the mainbody housing 2, but the upper, first medium supply cassette 3A is removed from the mainbody housing 2. In the description below, the side, portion, and end of the mainbody housing 2 and other components such as the first and second medium supply cassettes 3A, 3B, which are near the first and second front openings 20*a*, 21*a* will be referred to as front side, front portion, and front end, and the opposite side, portion, and end will be referred to as rear side, rear portion and rear end.

Figure 2:
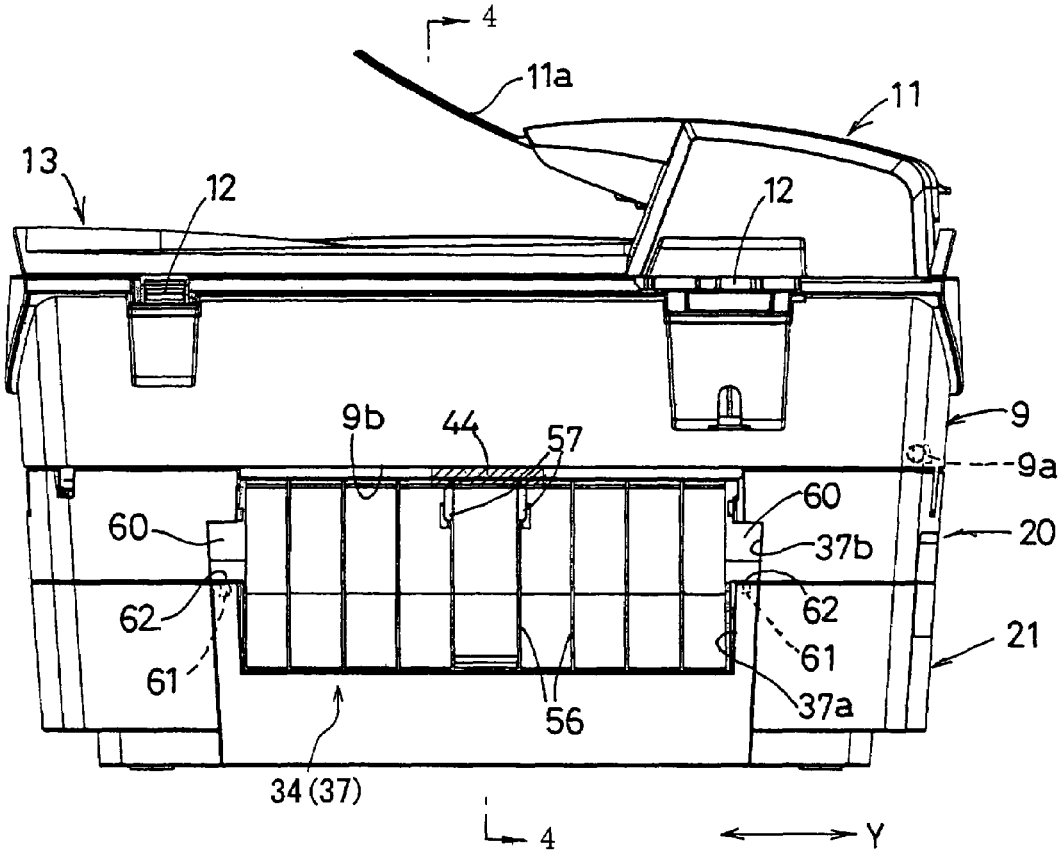
FIG. 2 is a rear view of the image recording apparatus.

An upper casing 9 of synthetic resin constituting an upper body portion of the apparatus 1 is connected to the upper side of the mainbody housing 2, such that the upper casing 9 is openable/closable relatively to the mainbody housing 2 by being turned upward/downward around an axis or a shaft 9*a* disposed at a right-hand end of a rear side portion of the mainbody housing 2, as seen in FIG. 2, of the mainbody housing 2 to extend in an X-axis direction as shown in FIG. 1. This arrangement facilitates operational work to eliminate paper jam, maintenance work for a recording portion 7, and work for replacing an ink cartridge or cartridges (not shown), by enabling to widely open the upper casing 9 to perform such works. An image reading device for reading a document when a copy function or a facsimile function is activated is disposed in the upper casing 9. The image reading device has a glass plate (not shown) on which a document sheet is placed, and a document cover structure 13 covering an upper surface of the glass plate. A rear end of the document cover structure is attached to a rear end of the upper casing 9 to be turnable upward and downward around a hinge 12. At a left-hand side portion of an upper surface of the document cover structure, namely, a left-hand end portion thereof as seen in FIG. 1, there is disposed a document automatic feeder 11 for separating a topmost one from a stack of document sheets one by one to feed each separated document sheet to the reading portion and then eject the document sheet. In an upper front portion of the upper casing 9, there is disposed an operator panel portion 14 where various operational buttons, a liquid crystal display and others are arranged, as shown in FIG. 1.

A document sheet is placed on the glass plate with a surface of the document sheet on which an image to be read is present facing downward, while the document cover structure is turned upward or opened. An image scanner for scanning documents in the form of a CIS (Contact Image Sensor), which is disposed to be reciprocable under the glass plate in a Y-axis direction shown in FIG. 1, reads the image on the document sheet. The Y-axis direction is a main scanning direction of the image scanner. On the other hand, when a stack of document sheets is set on a document supply table 11*a* of the document automatic feeder 11 with a surface of each document sheet on which an image to be read is present facing upward, the document sheets are fed one by one downward along a U-turn pathway (not shown), so that the image on each document sheet is read at a document reading portion which corresponds to a left-hand end portion, as seen in FIG. 1, of the glass plate, and the read document sheets are ejected in order onto a document catch table 13*a* constituted by the upper surface of the document cover structure, with the surface with the image facing downward.

Figure 4:
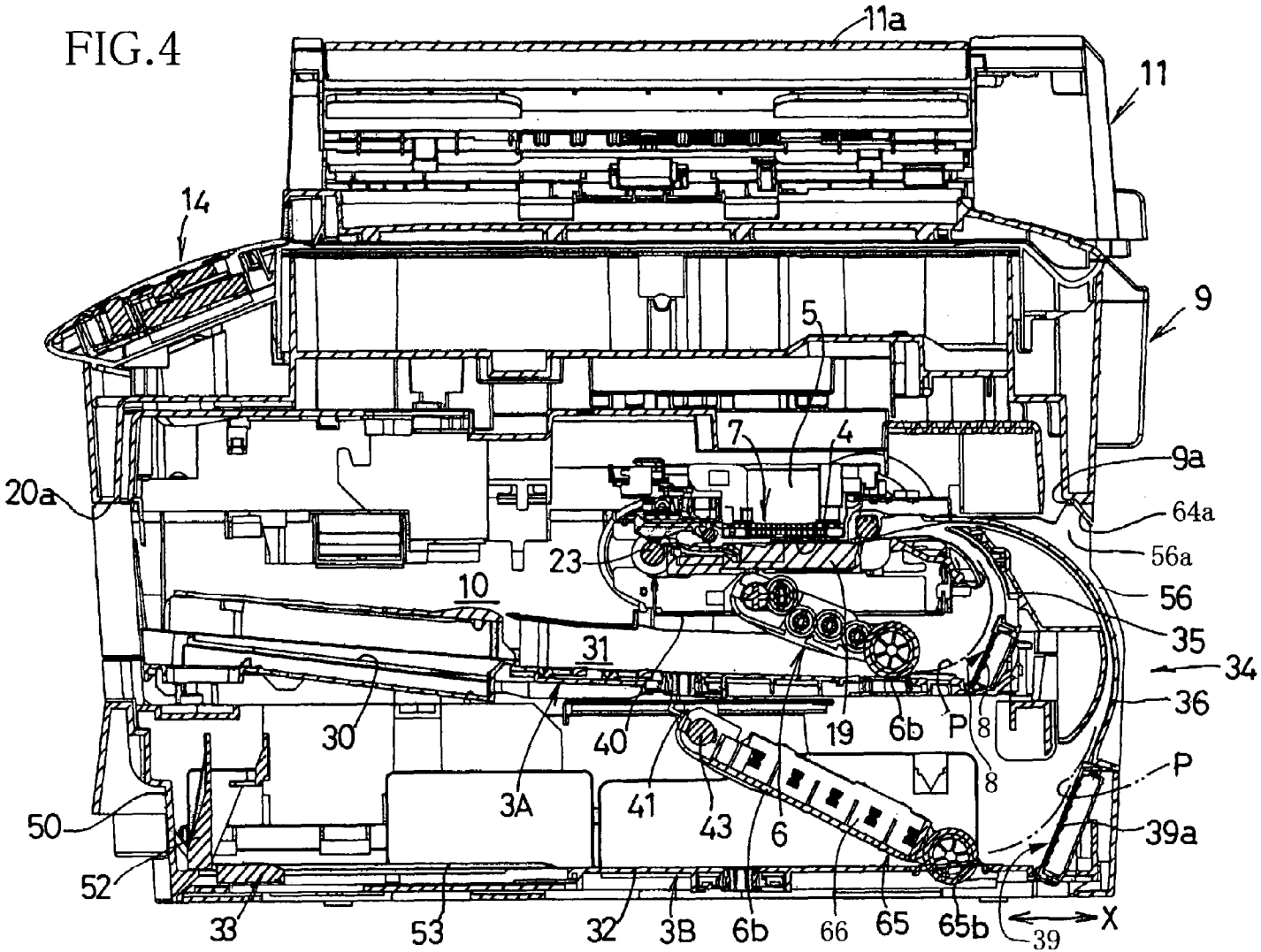
FIG. 4 is a cross-sectional view taken along line 4-4 in FIG. 2.
Figure 5:
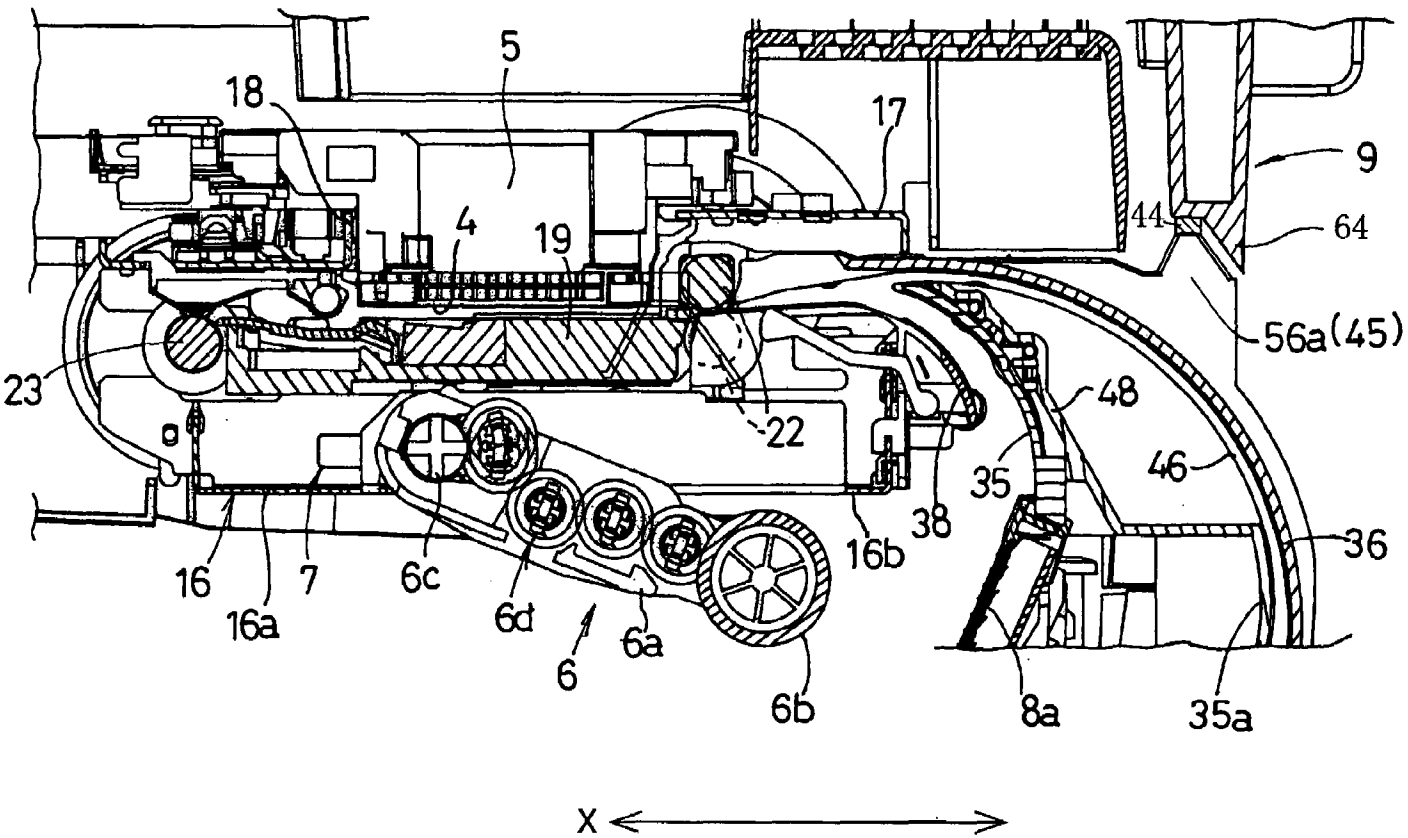
FIG. 5 is an enlarged view of a relevant portion of a recording portion and feed pathways in the mainbody housing.

The recording portion 7 as shown in FIGS. 4 and 5 is supported at a right side wall and a left side wall (not shown) of a main frame 16 which may be formed of metal. The recording portion 7 includes plate-like slide guiding members 17, 18 extending in the Y-axis direction or the main scanning direction, a carriage 5 slidably mounted across or supported by the slide guiding members 17, 18 to be reciprocable thereon, a timing belt (not shown) disposed parallel to and on an upper surface of the slide guiding member 18 to reciprocate the carriage 5, a CR (carriage) motor (not shown) for driving the timing belt, and a flat platen 19 for supporting a recording medium P fed under a recording head 4 mounted on the carriage 5.

A pair of registering rollers 22 are disposed on the upstream side, in a direction in which each recording medium P is fed (which will be hereinafter referred to as "feeding direction"), of the platen 19, so as to nip a recording medium P therebetween to feed the recording medium P to a place under the recording head 4. To the downstream side of the platen 19, a gear roller and an ejection roller 23 are disposed to contact an upper surface (i.e., a recording surface) and a back surface of recording medium P, respectively. The recording medium P on which an image has been recorded at the recording portion 7 is ejected onto a medium catch portion 10 with its recording surface facing upward. The medium catch portion 10 is formed on the upper side of the medium supply cassette 3A, so that an outlet communicated with the medium catch portion 10 is open in the front face of the mainbody housing 2 and at an upper portion of the first front opening 20*a*, as shown in FIG. 4.

There will be described a structure of a recording medium feeder. As described above, two medium supply cassettes 3A, 3B are disposed in vertical relation to each other in the present apparatus 1, and a first feeder 6 and a second feeder 65 that will be described later are provided for the respective medium supply cassettes 3A, 3B.

As shown in FIG. 4, the upper, the first medium supply cassette 3A is accommodated in the first lower casing 20 to be capable of advancing and retracting therein. The first medium supply cassette 3A can accommodate a stack of recording media P which may be cut paper sheets of various sizes such as A4, letter size, legal size, and postcard size. On the other hand, the lower, the second medium supply cassette 3B is accommodated in the second lower casing 21 to be capable of advancing and retracting therein. The second medium supply cassette 3B can accommodate a stack of recording media P similar to that the first medium supply cassette 3A can accommodate, but a vertical dimension of the second medium supply cassette 3B is larger than that of the second medium supply cassette 3B so that the maximum volume of the recording media P the second medium supply cassette 3B can accommodate is larger than that of the first medium supply cassette 3A.

Figure 7:
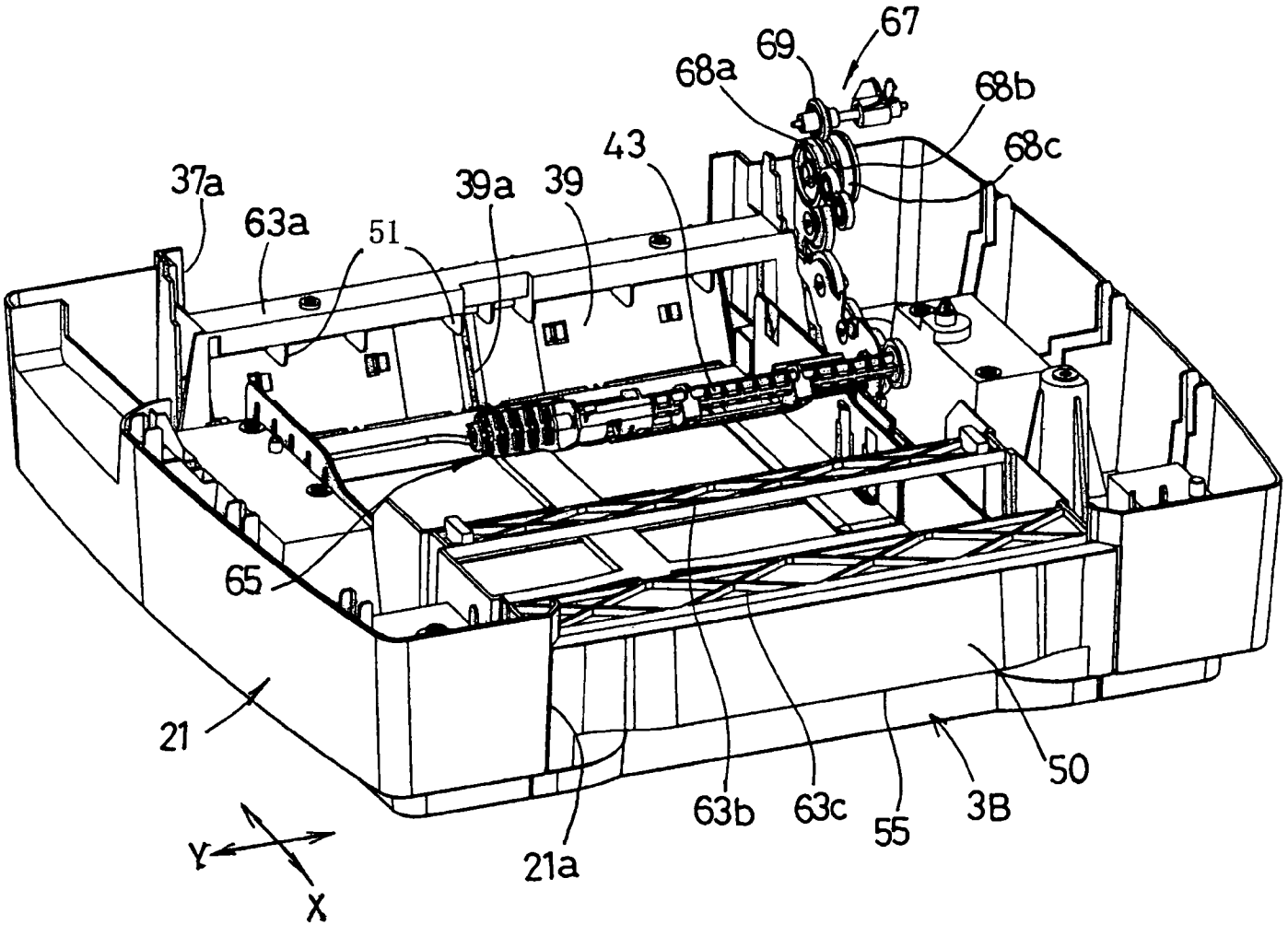
FIG. 7 is a perspective view of a second lower casing of the mainbody housing where a second medium supply cassette is accommodated in the second lower casing.

In the second lower casing 21 for accommodating the second medium supply cassette 3B, there are provided a plurality of reinforcing bars 63*a*, 63*b*, 63*c* above the second medium supply cassette 3B to extend across the second medium supply cassette 3B, in a direction perpendicular to the feeding direction parallel to an auxiliary scanning direction of the image scanner and the X-axis direction, as shown in FIG. 7. On the under side of the rearmost one of the reinforcing bars 63*a*, there are integrally formed a plurality of ribs 51 each extending along the feeding direction to serve a dual function as a guide and a reinforcing member, as shown in FIG. 7. The second lower casing 21 is box-shaped and open on its upper side, and connectable to the under side of the first lower casing 20 with screws or others (not shown).

The upper, first medium supply cassette 3A has an accommodating portion (main cassette portion) 31 which can accommodate a stack of recording media P with shorter sides of the stack parallel to the main scanning direction i.e., the Y-axis direction. At a front end portion of the first medium supply cassette 3A on the side of the front opening 20*a*, there is attached an auxiliary support 30 which is slidable outward in the X-axis direction so as to support a rear end portion of a relatively long recording medium P such as that of legal size. When a recording medium P which can be entirely accommodated in the first medium supply cassette 3A and does not project to the outside of the first lower casing 20 from the first front opening 20*a*, e.g., a recording medium of A4 size, the auxiliary support 30 is retracted and accommodated in the first medium supply cassette 3A, so as not to interfere with feeding of the recording medium, as shown in FIG. 2.

The second medium supply cassette 3B also has an extensible cassette portion 33 on the side of the second front opening 21*a* in the front face of the second lower casing 21. That is, the extensible cassette portion 33 constitutes a rear half, in a direction in which a recording medium is fed from the second medium supply cassette 3B, of a mainbody 32 of the cassette 3B, as shown in FIGS. 4 and 7. The extensible cassette portion 33 comprises: a front wall 50 capable of closing the second front opening 21*a* formed in the front face of the second lower casing 21; a left-hand support plate and a right-hand support plate each extending horizontally from a lower end of the front wall 50 so that a rear end portion of a recording medium P is placed on the left- and right-hand support plates; a central support plate; a plate-like operating part 52 standing to opposed to an inner surface of the front wall 50; and a flexible support plate 53 extending from a base portion of the operating part 52 to the downstream side in the feeding direction. When the extensible cassette portion 33 is held in a position near the rear half of the mainbody 32 of the second medium supply cassette 3B, a recording medium P of A4 size can be accommodated in the second medium supply cassette 3B. On the other hand, when the extensible cassette portion 33 is pulled out leftward as seen in FIG. 4 to increase the entire length of the second medium supply cassette 3B, a recording medium P of legal size which is longer than that of A4 size can be set on the medium supply cassette 3B.

Figure 6:
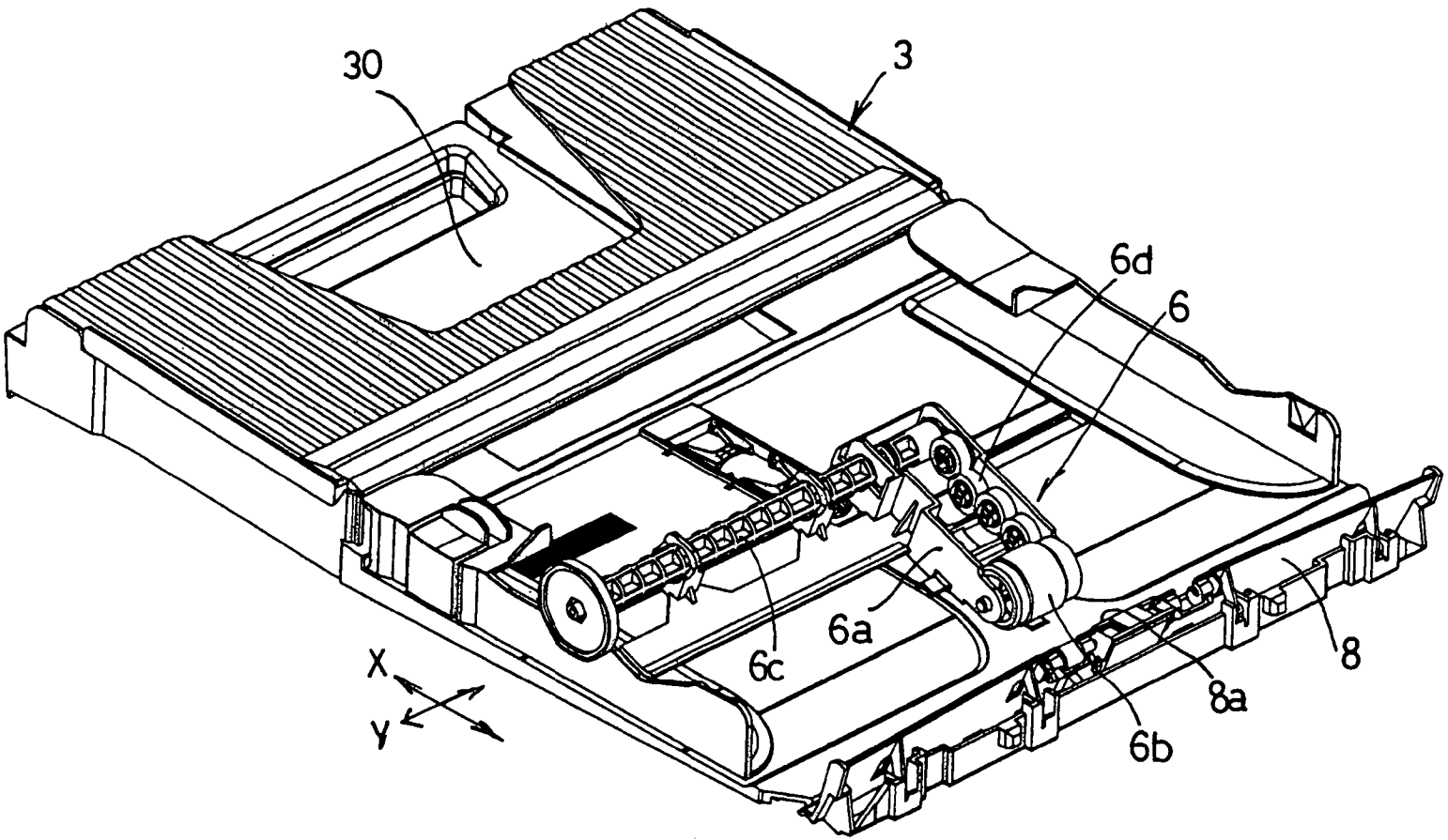
FIG. 6 is a perspective view of a first medium supply cassette accommodated in the mainbody housing.

At the rear sides (which is the right-hand side in FIG. 4) of the first and second medium supply cassettes 3A, 3B, a first inclined separator plate 8 and a second inclined separator plate 39 are disposed, respectively. The first and second inclined separator plates 8, 39 protrude at a central portion in a width direction of recording medium P, i.e., the Y-axis direction, so that the separator plates 8, 39 are curved rearward in a direction toward extreme lateral ends thereof. That is, the separator plates 8, 39 are curved to be convex frontward in plan view. At the central portion, in the width direction of the recording medium P, of each of the separator plates 8, 39, there is respectively disposed a first elastic separating pad 8*a* and a second elastic separating pad 39*a* that are like a saw-blade, so as to promote separation of each recording medium P by contacting a leading edge of the recording medium P, as shown in FIGS. 4, 6 and 7. The members 8, 39 cooperate with the first feeder 6 and the second feeder 65, respectively, to ensure separation and feeding of each recording medium P.

According to this arrangement where the inclined separator plates 8, 39 are provided at the downstream sides of the medium supply cassettes 3A, 3B, and the guide 34 is positioned adjacent to the mainbody housing 2 as well as the inclined separator plates 8, 39, a recording medium caught in either of the U-shaped pathways respectively extending from the inclined separator plates 8, 39 to the recording portion 7 can be eliminated only by removing the guide 34.

The first feeder 6 which separates and feeds one by one the recording media P stacked in the medium supply cassette 3A, is attached to the main frame 16 of the mainbody housing 2, as shown in FIGS. 4 and 5. The first feeder 6 has a first arm body 6*a* one end of which is pivotably supported by the main frame 16. To the other end of the first arm body 6*a*, which is a free end, there is rotatably attached a first feeder roller 6*b* for feeding the recording medium P.

In a bottom plate 16*a* of the main frame 16, there is formed an opening 16*b*. A pair of supporting plates (not shown) are formed on respective lateral sides of the opening 16*b* by cutting the bottom plate 16*a* and raising the two cut parts. A driving shaft 6*c* is inserted through the end of the first arm body 6*a* and supported by the supporting plates, so that the driving shaft 6*c* is rotatable. The first arm body 6*a* is rotatable around the driving shaft 6*c* so that the first arm body 6*a* is accommodated with the first feeder roller 6*b* in the opening 16*b*. The first arm body 6*a* incorporates a gear transmission 6*d* which transmits rotation of the driving shaft 6*c* to the first feeder roller 6*b*, as shown in FIG. 6.

The second feeder 65 which separates and feeds one by one the recording media P stacked in the second medium supply cassette 3B is disposed over the medium supply cassette 3B, as shown in FIG. 4. That is, between the first lower casing 20 and the second lower casing 21, an intermediate plate 40 (shown in FIG. 4) substantially rectangular in plan view extends in a direction perpendicular to the feeding direction. The intermediate plate 40 has a pair of supporting parts formed at a substantially central portion thereof by cutting two places of the intermediate plate 40 and bending the cut parts downward so that the two supporting parts stands parallel to each other. Each of the supporting parts has a shaft hole formed therethrough, and a driving shaft 43 of synthetic resin is rotatably supported by being inserted through the shaft holes. Between the supporting parts, the driving shaft 43 is inserted through a longitudinal end of a second arm body 66 which is substantially rectangular in plan view. The second arm body 66 and the driving shaft 43 are supported rotatably with respect to the shaft holes of the supporting parts. The driving shaft 43 is rotatably supported also by a support member formed by cutting a part in the intermediate plate 40 in a longitudinal end portion thereof and bending the cut part downward.

A second feeder roller 65*b* is rotatably attached to the other longitudinal end, which is a free end, of the second arm body 66 to feed recording medium P. The second arm body 66 incorporates a gear transmission (not shown) which transmits rotation of the driving shaft 43 to the second feeder roller 65*b*. When the driving shaft 43 is rotated by a drive motor (not shown) via the gear transmission in the second arm body 66, the second feeder roller 65*b* rotates in a predetermined direction.

There is provided a switcher 67 for selectively transmitting a driving force of a drive motor to one of: a gear transmission for the second feeder 65 for the second medium supply cassette 3B; a gear transmission for the first feeder 6 for the first medium supply cassette 3A; and a power transmission gear for a maintenance portion (not shown). The switcher 67 comprises three gears 68*a*, 68*b*, 68*c*, and a drive gear 69, as shown in FIG. 7, and the drive gear 69 selectively meshes one of the three gears 68*a*, 68*b*, 68*c* in accordance with an amount of displacement of the drive gear 69, to the right of the carriage 5 as seen in FIG. 4.

A radially outermost portion of each of the first and second feeder rollers 6*b*, 65*b* is made of synthetic rubber (e.g., elastomer and EPDM), for instance, and knurls are formed in a direction perpendicular to the feeding direction on an outer circumferential surface of each of the first and second feeder rollers 6*b*, 65*b*. The first arm body 6*a* and the second arm body 66 are respectively biased by biasing means such as torsion spring so that the free ends of the first and second arm bodies 6*a*, 66 are biased onto the stack of recording media P.

Each of the first and second feeders 6, 65 that has the arm body 6*a*, 66 pivotable around the shaft and provided with the drivable feeder roller at its free end, reliably feeds each recording medium toward the guide.

There will be now described guiding means for feeding a recording medium P from each of the first medium supply cassette 3A and the second medium supply cassette 3B to the recording portion 7, while reversing the recording medium P.

As shown in FIG. 2, a recording medium P supplied from the first medium supply cassette 3A is fed to the recording portion 7 disposed above the first medium supply cassette 3A, along a first pathway structure 35 defining a pathway U-turning sideways (feed pathway) for feeding a recording medium upward while reversing the medium. On the other hand, a recording medium P supplied from the second medium supply cassette 3B is fed along a second pathway structure 36 defining a pathway U-turning sideways (feed pathway). The first pathway structure 35 and the second pathway structure 36 are connected to form a guide 34 as shown in FIGS. 8-11. The guide 34 is removably attached in a space 37 formed in a rear side portion of the apparatus 1. A third pathway structure 38 for assisting in feeding and reversing of the recording medium P along the first pathway structure 35 is fixed to the main frame 16 positioned internally, or in front, of the first pathway structure 35, namely, on a side of the first pathway structure 35 which is near the recording portion 7, as shown in FIG. 5.

The space 37 is formed such that a rear side panel of the second lower casing 21 has a first cutout 37*a* as shown in FIG. 7, and a rear side panel of the first lower casing 20 has a second cutout 37*b*, and the first and second cutouts 37*b*, 37*a* are connected in a vertical direction, as shown in FIG. 2. A first engaging member 44 constituting a first engager is attached to an end surface 9*b* of the upper casing 9 which faces downward to the space 37. Although in the present embodiment the space 37 is formed to open in the rear side panels of the first and second lower cases 20, 21, it may be adapted such that the space 37 is formed across the mainbody housing 2 and the upper casing 9.

The position to attach the engaging member 44 corresponds to a position where an engaging portion 45 constituting a second engager is formed in the guide 34, as will be described later. However, it is preferable that the engaging member 44 is attached substantially at a center of the end surface 9*b* in the width direction of the recording medium P, i.e., the Y-axis direction. The engaging member 44 is a block member of elastic material, e.g., sponge and microcell urethane foam of silicone rubber, EPDM, and butyl rubber. The engaging member 44 is bonded with an adhesive to the end surface 9*b* of the upper casing 9 which faces downward.

Figure 12:
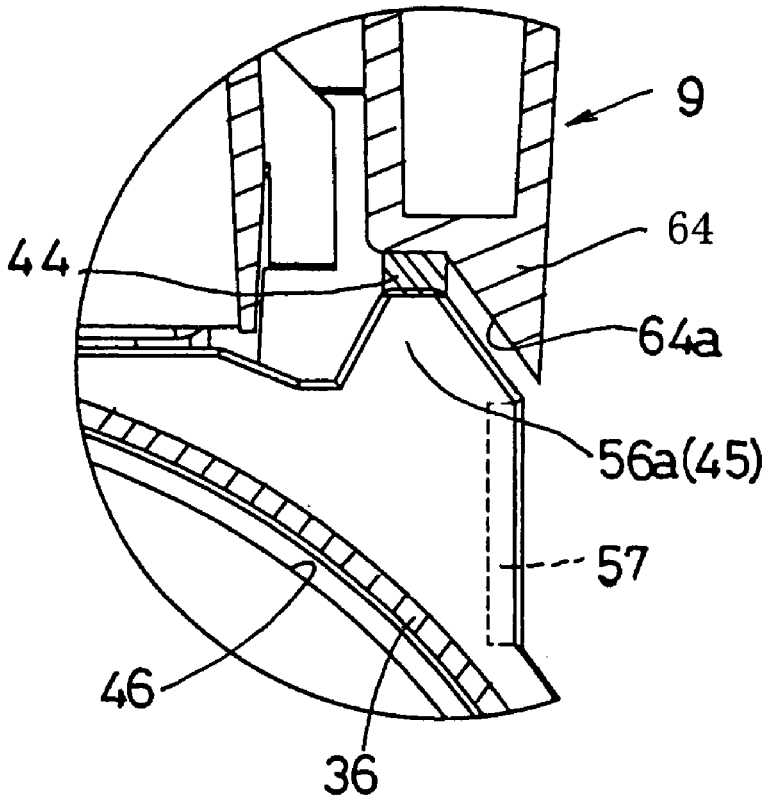
FIG. 12 is an enlarged cross-sectional view of a structure for fixing the guide.

A downward protrusion 64 is integrally formed in the end surface 9*b* of the upper casing 9 which faces downward. The downward protrusion 64 is positioned externally of the engaging member 44. An internal surface of the downward protrusion 64 is constituted by a guide surface 64*a* which is inclined downward in a rearward direction, as shown in FIG. 12. By this arrangement, the engaging portion 45 of the guide 34 as attached in the space 37 is guided to the inside of the mainbody housing 2, and thus the guide 34 is prevented from disengaging or running off outward from the apparatus 1. An end face of the engaging portion 45 is inclined to be substantially parallel to the inclined guide surface 64*a* of the downward protrusion 64 of the upper casing 9, as shown in FIG. 12. However, to have the end face of the engaging portion 45 inclined in this way is not essential.

Figure 11:
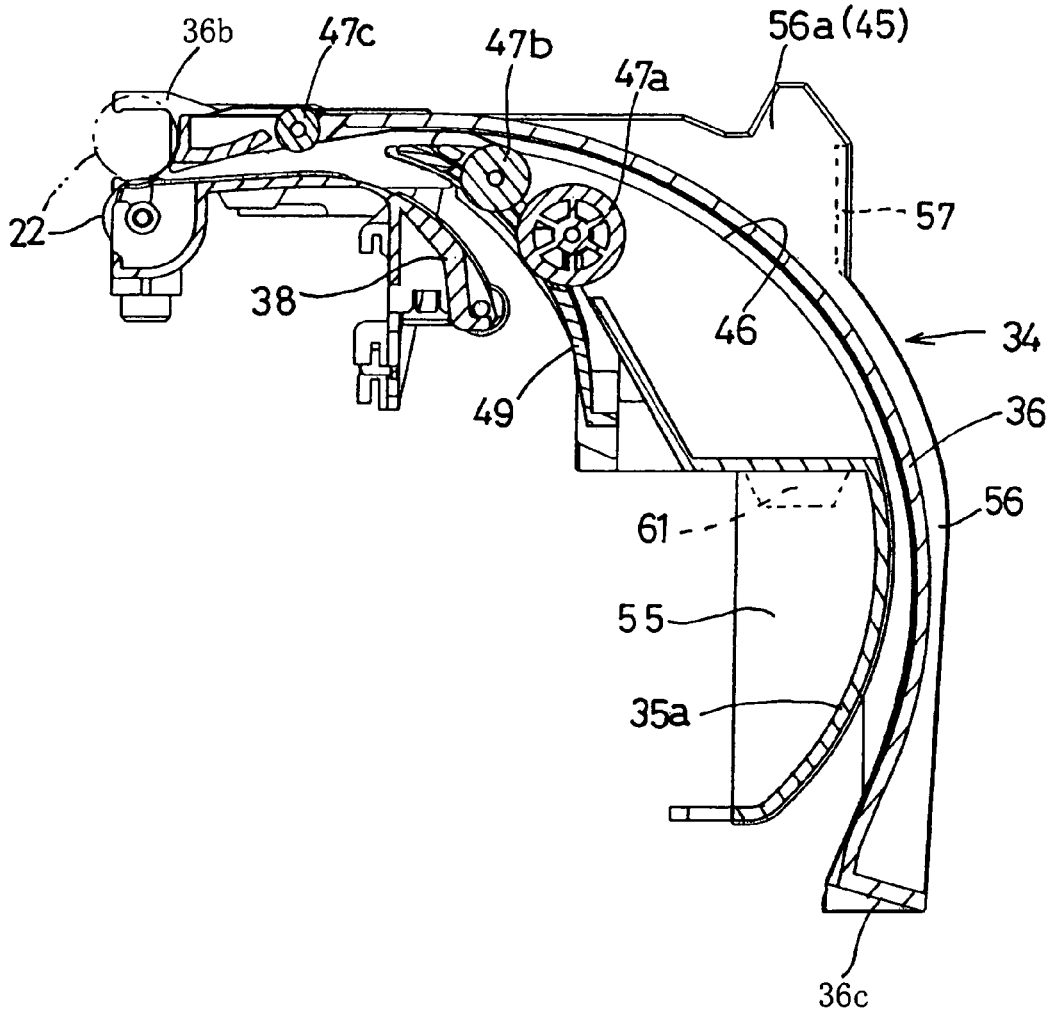
FIG. 11 is a cross-sectional view of the guide taken along line 11-11 in FIG. 8.

As shown in FIG. 11, the second pathway structure 36 is disposed on the external or rear side of the first pathway structure 35, and accordingly a curvature radius of the U-turn pathway defined immediately inside the second pathway structure 36 is larger than that of the U-turn pathway defined inside the first pathway structure 35. A plurality of guide ribs 46 are integrally formed on a rear side of the first pathway structure 35 to protrude in a circular or arcuate shape, so as to be opposed to an internal surface of the second pathway structure 36. The first and second pathway structures 35, 36 are connected to each other such that an end portion of the first pathway structure 35 on the downstream side in the feeding direction meets the second pathway structure 36 with a clearance therebetween at a place near an end of the structure 36 on the downstream side in the feeding direction. Thus, the U-turn pathway defined inside the first pathway structure 35 merges with the U-turn pathway defined immediately inside the second pathway structure 36 at the place near the end of the structure 36, and the merged pathway extends to the recording portion 7.

Figure 8:
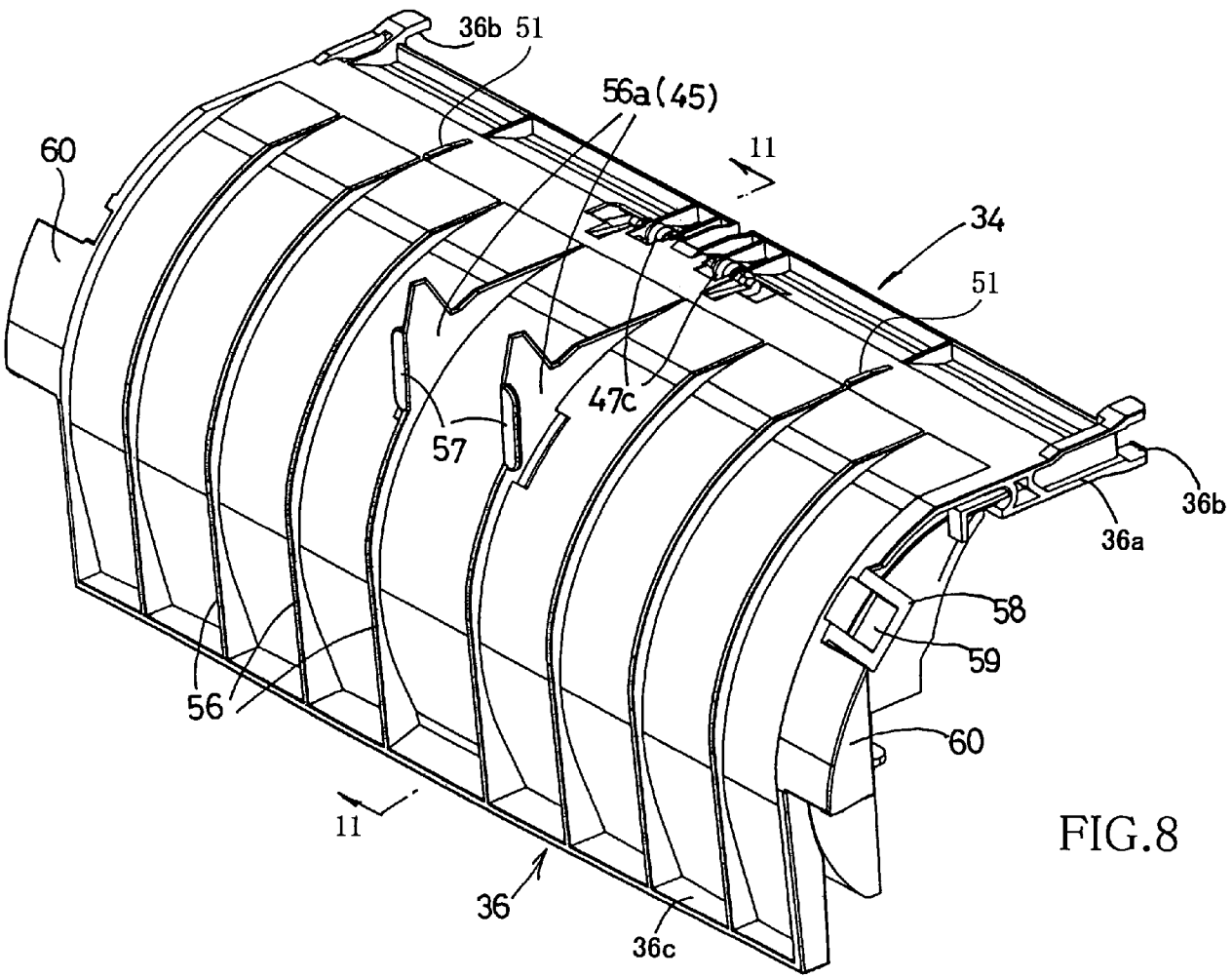
FIG. 8 is a perspective rear view of a guide defining the feed pathways.
Figure 9:
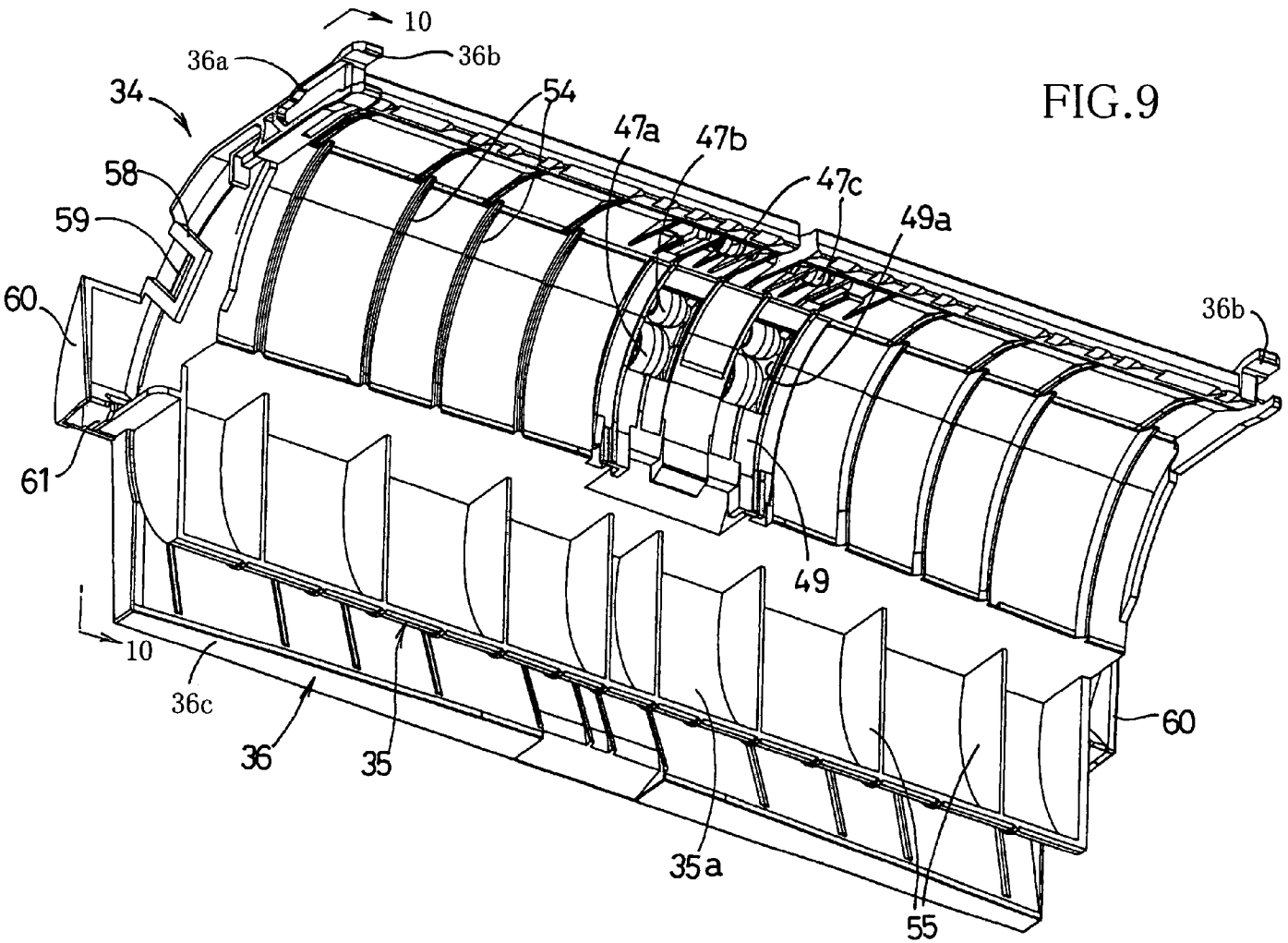
FIG. 9 is a perspective front view of the guide.

The first pathway structure 35 and the second pathway structure 36 have a plurality of freely rotatable rollers around the place where the two U-turn pathways defined by the first and second pathway structures 35, 36 merge, so as to assist in feeding of recording medium P. More specifically, a plurality of pairs of rollers are disposed at suitable intervals along the feeding direction of recording medium P at a substantially central portion in the width direction of recording medium P, with each pair of rollers adjacent to each other in the width direction of recording medium P, as shown in FIGS. 8, 9 and 11. The plurality of pairs of rollers comprise a first pair 47*a* of rollers and a second pair 47*b* of rollers that are disposed on the first pathway structure 35, and a third pair 47*c* of rollers disposed on the second pathway structure 36. That is, at a central portion of the first pathway structure 35 in a lateral direction of the apparatus 1, an accommodating recess 48 for accommodating the first pair 47*a* of rollers and the second pair 47*b* of rollers is formed. In front of the accommodating recess 48, a cover 49 providing a guide surface is detachably attached. The cover 49 has a window opening 49*a* through which the first and second pairs 47*a*, 47*b* of rollers are exposed to the pathway along which a recording medium P passes, as shown in FIG. 9.

On a downstream portion, in the feeding direction, of an internal surface of the first pathway structure 35, there are integrally formed a plurality of guide ribs 54, each arcuate as seen from a lateral side, on each of laterally opposite sides of the cover 49. An upstream portion of the first pathway structure 35 is constituted by a plate portion 35*a* that is circular or arcuate continuously from the guide ribs 46. On an internal surface of the arcuate plate portion 35*a*, a plurality of inner reinforcing ribs 55 are formed, as shown in FIGS. 9 and 11.

On an external surface of the second pathway structure 36, a plurality of outer reinforcing ribs 56 extend. Each of some, namely, a pair in the present specific example, of the outer reinforcing ribs 56 that are located at a central portion in the lateral direction that is perpendicular to the feeding direction, has an integrally formed extending portion 56*a* constituting the engaging portion 45 and protruding farther than the rest part of the outer reinforcing rib 56, as shown in FIGS. 8 and 11. These extending portions 56*a* are substantially horizontal. The above arrangement where a first engager in the form of the downward protrusion is on the upper body portion, and a second engager in the form of the extending portion 56*a* is formed on the external surface of the guide 34 is advantageous in that the first engager does not tend to interfere with or touch the other members than the second engager upon closing of the upper body portion to engage the first engager with the second engager.

A lug 57 L-shaped in cross section is integrally formed on a rear side of each extending portion 56*a*, as shown in FIGS. 8 and 11, so that the user holds the lug 57 as a finger grip when handling the guide 34 (the second pathway structure 36). Thus, handling of the guide 34 is facilitated by the lug 57.

Figure 10:
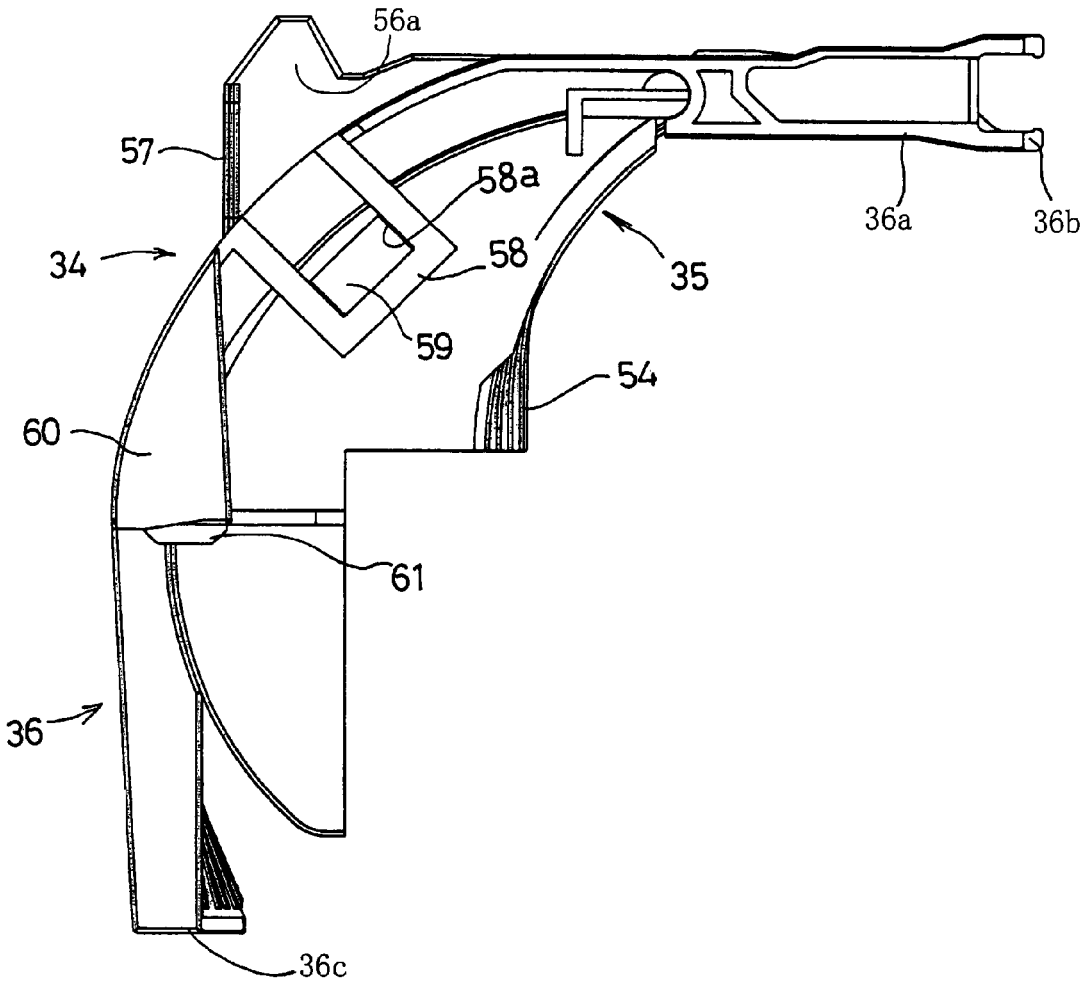
FIG. 10 is a side view of the guide as seen in a direction of arrows 10, 10 in FIG. 9.

An retaining member 58, that is generally U-shaped as seen from a lateral side and having a hole 58*a*, is integrally formed at each of lateral ends of the second pathway structure 36, while an engaging protrusion 59 is integrally formed at each of lateral ends of the first pathway structure 35, as shown in FIGS. 8-10. When the first pathway structure 35 and the second pathway structure 36 are assembled, the second pathway structure 36 is put on an external surface of the first pathway structure 35, and the engaging protrusion 59 are fitted in the holes 58*a* of the retaining members 58 at the lateral ends of the second pathway structure 36 so that the first and second pathway structures 35, 36 are fixed to each other.

A protruding portion 60 is integrally formed at each of the lateral ends of the second pathway structure 36, to protrude outward. A tab 61 is integrally formed inside each of the protruding portions 60, to protrude downward. In FIGS. 9 and 10, one of the two tabs 61 is shown. On each of opposite lateral sides of the first cutout 37*a* formed in the second lower casing 21, there is a horizontal support surface 62, and the left and right protruding portions 60 of the second pathway structure 36 are placed on the horizontal support surfaces 62 when the guide 34 is set in the space 37 open in a rear face of the apparatus 1. Thus, the vertical position of the guide 34 in the downward direction is determined. Each of the horizontal support surfaces 62 has a recess (not shown) in which the tab 61 is loosely fitted. This engagement between the recess and the tab 61 prevents displacement or rattling of the guide 34 in the lateral direction as well as the front-rear direction, to some extent. That is, the guide 34 is positioned mainly by the fitting of a pair of bifurcating portions 36*b* of the guide on a shaft, as fully described later, but the fitting of the tabs 61 in the recesses also serves to position the guide to a degree to ensure that the downward protrusion 64 can properly engage the extending portions 56*a*, namely, the downward protrusion 64 is located on the external or rear side of the extending portions 56*a*.

Two horn-like arms 36*a* protrude frontward from respective lateral ends of an upper surface of the second pathway structure. Each of the arms 36*a* has a bifurcating portion 36*b*, which is fitted on a shaft of an upper one of the pair of registering rollers 22. Thus, the guide 34 is positioned in the space 37 with respect to feeding of a recording medium, with the left and right protruding portions 60 resting on the horizontal support surfaces 62, and the bifurcating portions 36*b* of the arms 36*a* being fitted on the shaft of the upper registering roller 22. Displacement of the guide 34 in a width direction of the recording medium is restricted by contact of the external surface of each of the two arms 36*a* with a raised portion in an internal surface of the first lower casing 20. It is noted that in the invention the term "restrict" is used to mean that the guide is allowed to be displaced in a small amount and thus rattling thereof is allowed to some extent, while the term "inhibit" is used to mean that the guide is allowed to neither rattle nor displace.

As the bifurcating portions 36*b* wear out by rotation of the upper registering roller 22, the guide 34 becomes to tend to come off. However, the vertical position of the guide 34 with respect to the upward direction is defined by contact of the guide 34 with a lower end surface of the slide guiding member 17 shown in FIG. 5. Two ribs 51 are disposed on an upper external surface of the second pathway structure 36 so that the two ribs are brought into contact with the lower end surface of the slide guiding member 17. However, in place of the ribs 51, at least one protrusion may be disposed on the lower end surface of the slide guiding member 17 so that the at least one protrusion is brought into contact with the upper external surface of the second pathway structure 36.

Figure 3:
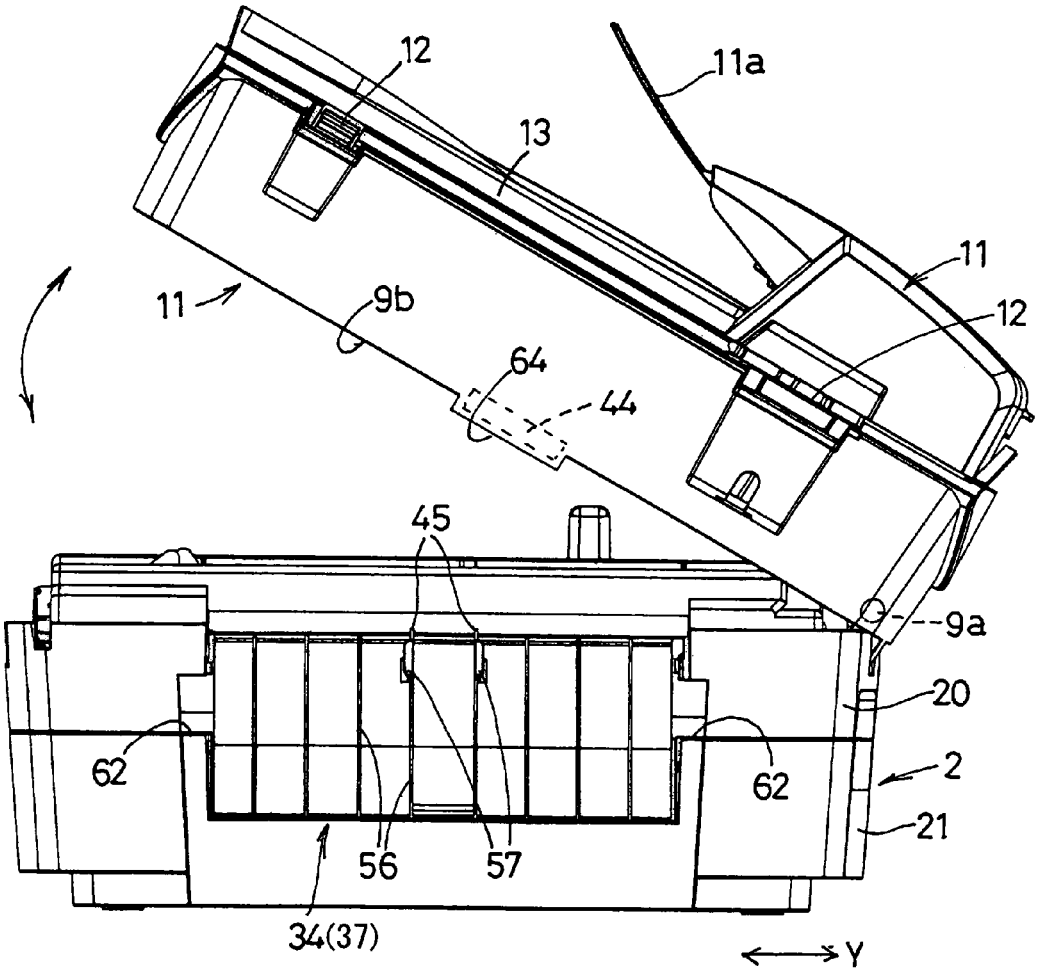
FIG. 3 is a rear view of the image recording apparatus in a state where an upper casing thereof is open with respect to a mainbody housing thereof.

When assembling the guide 34 to the image recording apparatus 1 as described above, the upper casing 9 is widely opened with respect to the mainbody housing 2, as shown in FIG. 3. Then, a laterally longitudinal lower end plate 36*c* of the second pathway structure 36 of the guide 34 is placed on a surface of the second lower casing 21 which faces upward and defines a bottom of the first cutout 37*a*, with the bifurcating portions 36*b* of the arms 36*a* fitted on the shaft of the upper registering roller 22. The protruding portions 60 at the lateral ends of the second pathway structure 36 rest on the horizontal support surfaces 62, with the tabs 61 fitted in the pits formed in the horizontal support surfaces 62. Then, the upper casing 9 is turned downward or closed, as shown in FIG. 2, such that the end surface 9*b* of the upper casing 9 facing downward and an upper end surface of the guide 34 become parallel to each other, with a lower surface of the elastic engaging member 44 attached to the upper casing 9 is pressed onto an upper end surface of each engaging portion 45, i.e., the extending portion 56*a*, which takes the form of a plate-like rib, so that the engaging portion 45 (56*a*) bites into the elastic member. In this way, the guide 34 is set in the space 37 in the rear portion of the mainbody housing 2 and the upper casing 9 to close the space 37 against the outside of the apparatus, and does not come off even when vibration or impact is imposed on the apparatus.

As shown in FIG. 4, a recording medium P fed out from the first medium supply cassette 3A is transferred to the recording portion 7 disposed above the first medium supply cassette 3A, along the upper sideways U-turn pathway defined inside the first pathway structure 35, and a recording medium P fed out from the second medium supply cassette 3B is transferred to the recording portion 7 along the upper sideways U-turn pathway defined immediately inside the second pathway structure 36. As being thus fed along a curved surface of the first pathway structure 35 or the second pathway structure 36, the recording medium P, which has a certain degree of rigidity and accordingly a resistance to being bent, presses the guide 34. However, according to the present embodiment, the guide 34 is prevented from coming off of the mainbody housing 2 and the upper casing 9, outward or rightward as seen in FIG. 5. Hence, the guide 34 is prevented from falling off due to the looseness in fitting thereof in the space 37, an impact imposed on the apparatus 1, or some other reasons, even while the image recording apparatus 1 is transported.

The downward protrusion 64 having the guide surface 64*a* inclined to the external side in the downward direction is formed on a lower end of the upper casing 9. Therefore, when the upper casing 9 is closed or turned downward, the inclined guide surface 64*a* guides the guide 34 into the mainbody housing 2, thereby positioning the guide 34. Where the guide 34 is in a tilted position, the inclined guide surface 64*a* is brought into abutting contact with the engaging portion 45 (56*a*), and accordingly the upper casing 9 can not be completely closed, thereby the user can recognize that the guide 34 is not in position.

When a recording medium P is caught between the second pathway structure 36 and the first pathway structure 35, or the second pathway structure 36 and the third pathway structure 38, or between the pair of registering rollers 22, while the recording medium P is fed toward the recording portion 7, the recording medium P can be easily removed by widely opening the upper casing 9 upward, as shown in FIG. 3, and then detaching the guide 34. That is, the guide 34 is easily detached by releasing the engagement between the engaging member 44 and the downward protrusion 64 by merely opening the upper casing 9.

Figure 13:
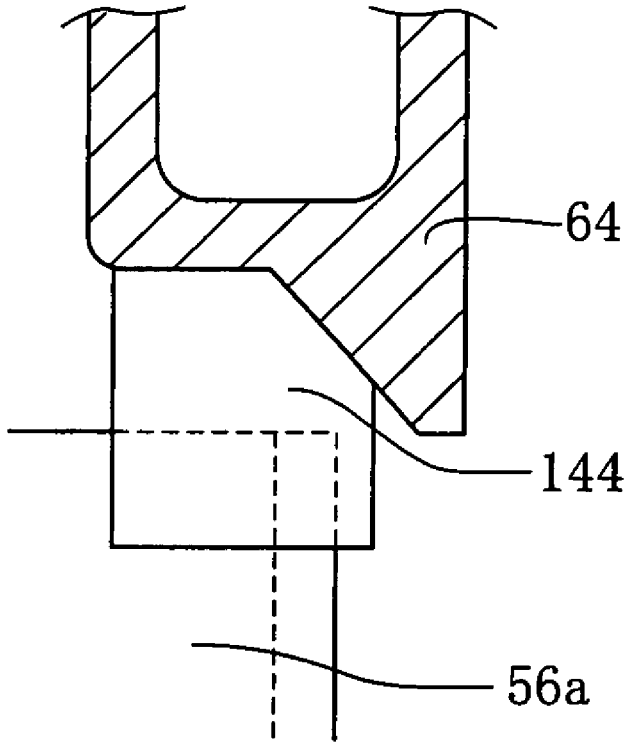
FIG. 13 is an enlarged cross-sectional view of a structure for fixing a guide in an image recording apparatus according to a second embodiment.

There will be now described an image recording apparatus 100 according to a second embodiment of the invention, by referring to FIG. 13. In the following description with respect to the second embodiment, parts or elements corresponding to those of the first embodiment will be denoted by the same reference numerals and description thereof is not provided.

As shown in FIG. 13, in this embodiment, an elastic member 144 constituting a second engager is bonded to a surface of an extending portion 56*a* of a guide 36, and not attached to an upper casing 9. On a lower end surface of the upper casing 9, there is formed a downward protrusion 64 as a first engager. The downward protrusion 64 has an inclined surface 64*a* similar to that in the first embodiment that is to engage extending portions 56*a* of ribs 56 integrally formed on a second pathway structure 36 when the upper casing 9 is closed or turned downward. Unlike the first embodiment, there is no clearance between the inclined surface 64*a* of the downward protrusion 64 and the extending portion 56*a* when the upper casing 9 is closed, but the inclined surface 64*a* is brought into contact with the elastic member 144. By this contact, a displacement of a guide 34 in the vertical direction as well as outward can be prevented.

Figure 14:
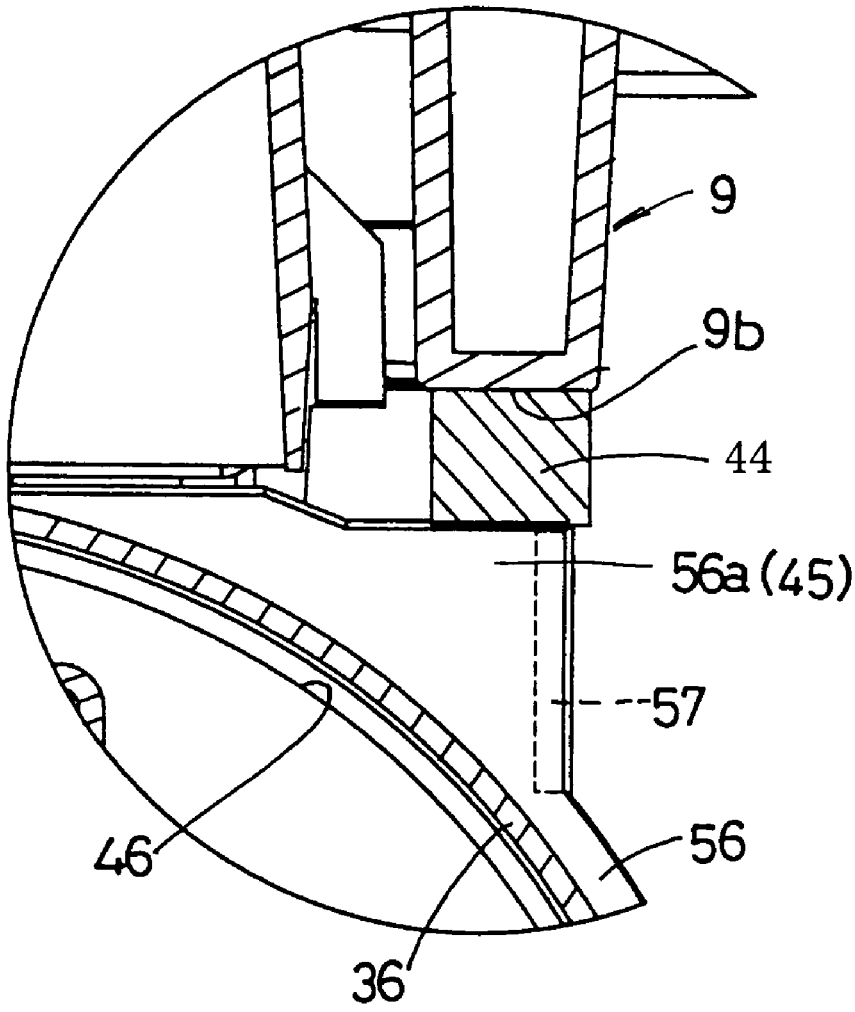
FIG. 14 is an enlarged cross-sectional view of a structure for fixing a guide in an image recording apparatus according to a third embodiment.

There will be now described an image recording apparatus according to a third embodiment of the invention, by referring to FIG. 14. The third embodiment is similar to the first embodiment except some parts. The elements or parts corresponding to those of the first embodiment will be denoted by the same reference numerals and description thereof is not provided.

In the third embodiment shown in FIG. 14, at a place where an elastic engaging member 44 constituting a first engager is attached to an upper casing 9, there is not formed a downward protrusion 64 with an inclined guide surface 64*a*. In the present embodiment, too, a guide 34 disposed in a space 37 can be set in position when the upper casing 9 is closed with respect to a mainbody housing 2, and rattling of the guide 34 is prevented.

In each of the first through third embodiments, the first engager and the second engager are normally in pressing contact with each other, but this pressing contact is not essential to attain the object of the invention. That is, the first and second engagers may not be in contact with each other while the guide 34 is neither rattling nor displaced.

It is not essential to make on purpose at least one of the first and second engagers easily deformable.

Further, in each of the first and third embodiments, the engaging member 44 may be formed integrally with the upper casing 9, using the same synthetic resin as that of the upper casing 9. Similarly, in the second embodiment, the elastic member 144 may be formed integrally with the extending portion 56*a* in the guide 34, using the same synthetic resin as that of the pathway structures 35, 36 of the guide 34. When the engaging member 44 is formed integrally with the upper casing 9, or when the elastic member 144 is formed integrally with the extending portion 56*a* on the guide 34, as described above, the number of components as well as the manufacturing cost of the apparatus can be reduced.

Figure 16:
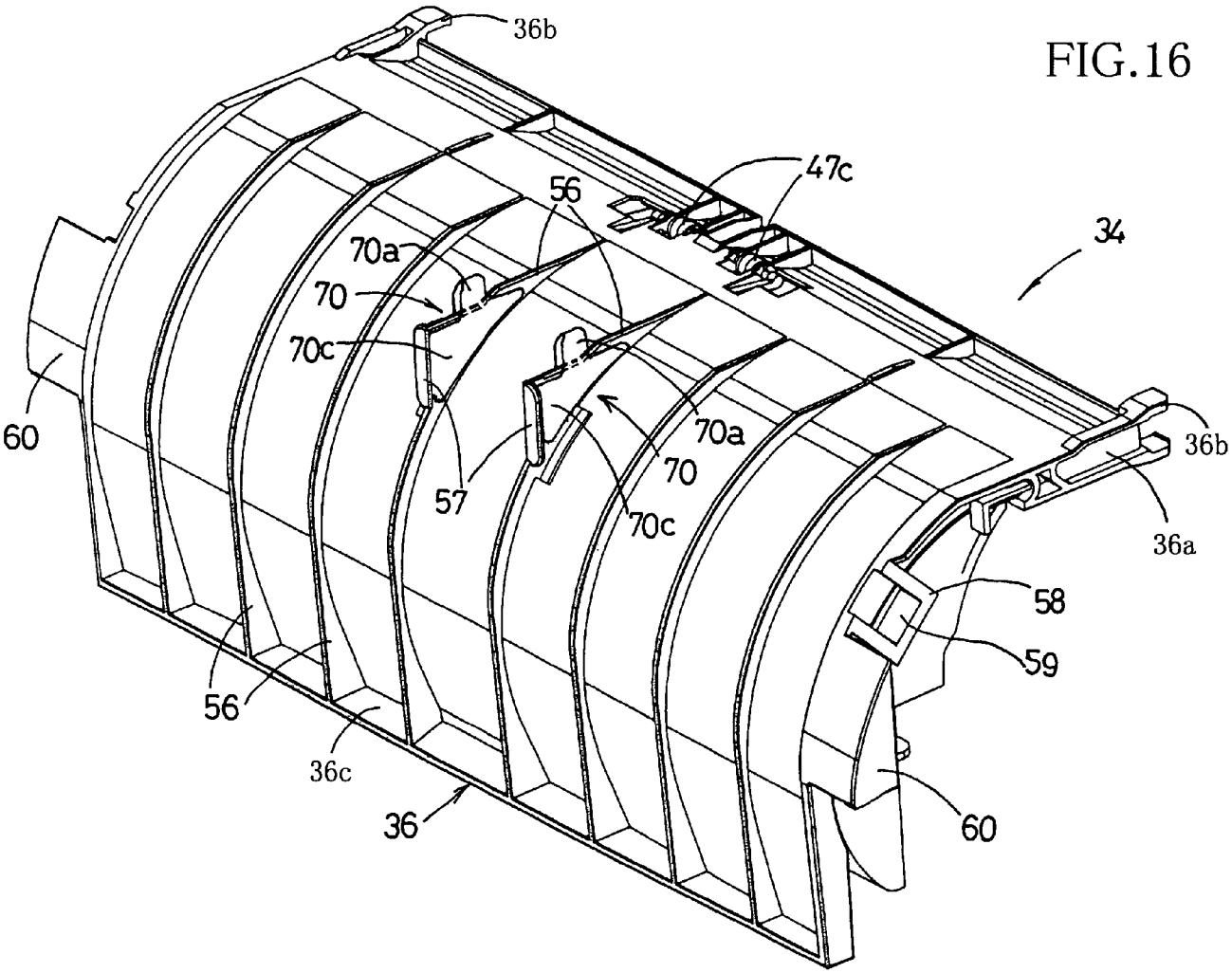
FIG. 16 is a perspective view of the guide to which the butterfly member is attached.
Figure 17:
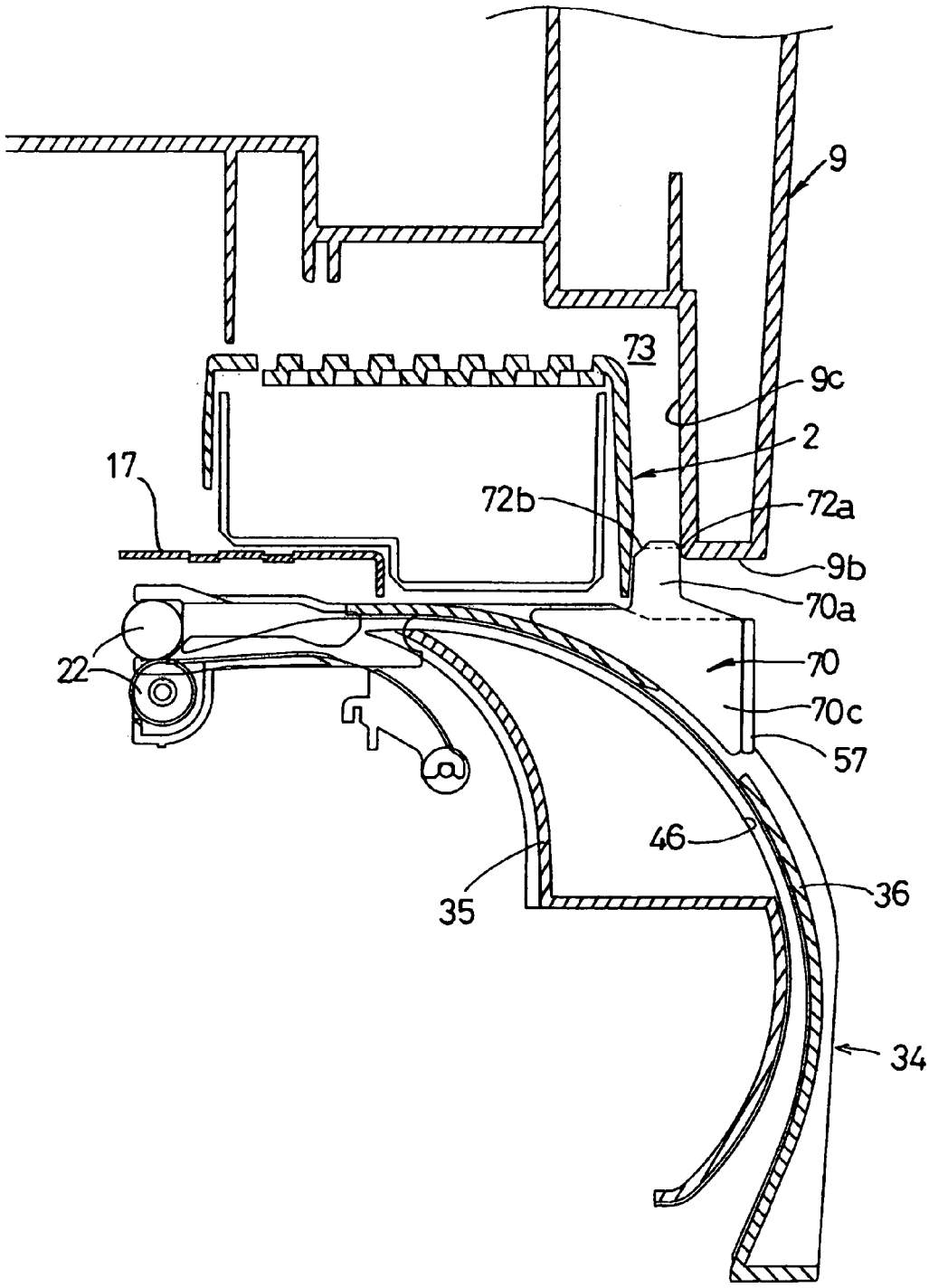
FIG. 17 is a view showing a relevant part of the apparatus in enlargement.

There will be described an image recording apparatus according to a fourth embodiment of the invention, by referring to FIGS. 15-17. The parts or elements corresponding to those of any of the above-described embodiments will be denoted by the same reference numerals and description thereof is not provided.

Figure 15:
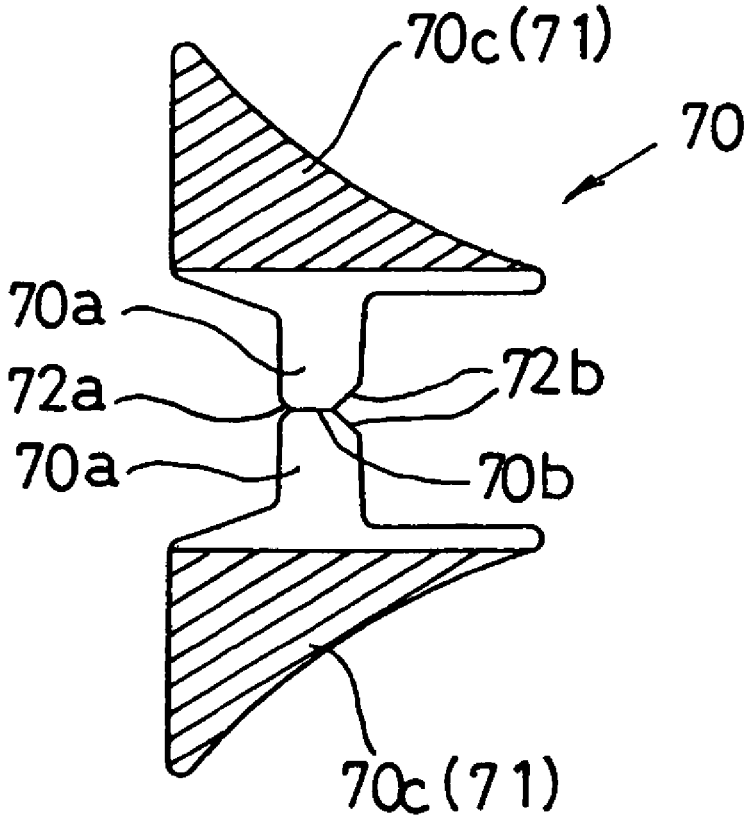
FIG. 15 is a developed view of a butterfly member constituting a second engager in the apparatus.

In the fourth embodiment, each of a plurality of second engagers is constituted by a butterfly member 70 as shown in FIG. 15. The butterfly member 70 has a pair of protruding portions 70*a* that are contiguous and symmetric with respect to a line 70*b* which corresponds to an upper end as described later, and a pair of substantially triangular proximal portions 70*c* each of which is continuous from one of the protruding portions 70*a*. The butterfly members 70 are die-cut from a synthetic resin film of PET or other materials. On a side of each of the proximal portions 70*c*, which is to be an inner side, a double-faced adhesive tape 71 as indicated by hatching in FIG. 15 is adhered.

A plurality of plate-like reinforcing ribs 56 are formed on an external surface of a second pathway structure 36 of a guide 34. When each of the butterfly members 70 is assembled, a release tape (not shown) on each double-faced adhesive tape 71 is peeled off, and then the proximal portions 70*c* of the butterfly member 70 are attached to opposite sides of one of some, namely a pair in the present embodiment, of the reinforcing ribs 56 that are located at a central portion in a direction perpendicular to a direction of feeding recording medium, i.e., a lateral direction of the guide 34, such that the butterfly member 70 is folded in half at the line 70*b*, which forms the upper end of the butterfly member 70 as assembled. In this way, the butterfly member 70 is attached to protrude upward from an upper surface of the outer reinforcing rib 56, as shown in FIG. 16. Each protruding portion 70*a* has a first guide edge 72*a* and a second guide edge 72*b* that are inclined in opposite directions. The first guide edge 72*a* is formed between the upper end 70*b* and a rear end of the protruding portion 70*a*, and the second guide edge 72*b* is formed between the upper end 70*b* and a front end of the protruding portion 70*a*.

The guide 34 on which the butterfly member 70 is attached is set in the space 37*a* in the mainbody housing 2, and then an upper casing 9 is closed, with the first and second guide edges 72*a*, 72*b* of the protruding portions 70*a*, that now takes the form of a relatively thin protrusion constituting a second engager, being guided on and along an internal surface 9*c* at a lower end portion of the upper casing 9 and a surface of the mainbody housing 2 that are accessible from the lower side of the upper casing 9. In this way, the protruding portions 70*a* of the thin protrusion is guided in a gap 73 formed between the upper casing 9 and the mainbody housing 2 so as not to easily come off, and thus constitutes a second engager. This prevents the guide 34 from easily coming off. In the present embodiment, where the user removes the guide 34 by force while the upper casing 9 is closed with respect to the mainbody housing 2, the protruding portions 70*a* or the thin protrusion formed of a film material to be elastic deforms to allow coming off of the guide 34 upon a force beyond a resisting force of the protruding portions 70*a* is imposed. In contrast, where each of the thin protrusion is formed integrally with the outer reinforcing rib 56 of the guide 34 by using the same material as the reinforcing rib 56, the guide 34 may break at the outer reinforcing rib or ribs 56 when the guide 34 is removed by force. The guide member 34 according to the present embodiment is free from this problem. Further, since the protruding portions 70*a* or the thin protrusion is formed of an elastic film material, even when an end surface 9*b* of the upper casing 9 is brought into abutting contact with the thin protrusion upon closing of the upper casing 9 with the guide 34 set in the space 37 in the mainbody housing 2 improperly, that is, the posture and/or location of the guide 34 being improper, the end surface 9*b* merely presses and deforms the thin protrusion 70*a* and does not cause damage to the guide 34. Still further, even when the guide 34 receives a resisting force from a recording medium P passing and reversed along an internal surface of the guide 34 by being bent in a U-like shape, and is thus pressed to the external side of the mainbody housing 2, the thin protrusion 70*a* made of a film material does not tend to deform in a direction parallel to a surface thereof, thereby preventing the guide 34 from coming off of the image recording apparatus.

In each of the first through third embodiments where engagement between the guide and the upper casing 9 is established via an elastic member, i.e., the elastic engaging member 44 or the elastic member 144, the engagement is maintained while deformation of the elastic member is allowed. Thus, it is easily enabled to hold the upper casing 9 closed with respect to the mainbody housing 2 without rattling of the guide 34.

In each of the first and third embodiments, since the extending portion 56*a* is formed in the form of a rib, when the elastic member 44 engages the extending portion 56*a*, an upper end portion of the extending portion 56*a* bites into the elastic member 44, thereby providing a relatively large force against the rattling and displacement of the guide. Thus, the guide 34 is further reliably prevented from coming off.

In each of the above-described embodiments, since the lug 57 to be held by the user is integrally formed in the extending portion 56*a* of the reinforcing rib 56, the guide 34 is simplified in structure, thereby reducing the manufacturing cost of the apparatus. Further, since the second engager is provided by or on the extending portion 56*a* of the rib 56, the effect of simplifying the structure of the guide 34 and reducing the manufacturing cost is enhanced.

In each of the above-described embodiments, the engagement between the upper casing 9 and the guide 34 is released by merely turning the upper casing 9 upward and away from the mainbody housing 2. Hence, the guide 34 is extremely easily removable. Accordingly, in the case of a jam, the recording medium can be easily eliminated.

In the above-described embodiments, the shaft 9*a* around which the upper casing 9 is pivotally supported is disposed to be parallel to the direction of feeding of recording medium P. However, the same operation and effects as the above-described embodiments can be obtained even when the shaft 9*a* of the upper casing 9 is disposed to be perpendicular to the feeding direction.

In the invention, the first and second engagers may or may not be in direct contact with each other. However, provision of an elastic member between the upper casing and the guide prevents rattling therebetween, and also rattling of the second pathway structure 36.

In the invention, the "lower body portion" is not limited to a mainbody housing made of synthetic resin as that in the embodiments, but may be a metallic mainbody frame enclosed in such a mainbody housing, and the "upper body portion" is not limited to an upper casing made of synthetic resin as that in the embodiments, but may be a metallic upper frame enclosed in the upper casing.

What is claimed is:

1. An image recording apparatus comprising:

a lower body portion including:

a curved feed pathway;

an image recording device; and a recording medium feeder which feeds one by one a plurality of recording media as stacked, into the feed pathway and toward the image recording device;

an upper body portion which is disposed above the lower body portion and openable with respect to the lower body portion by being displaced upward;

a guide which defines at least a part of the feed pathway, and is removably placed on the lower body portion;

a first engager disposed in the upper body portion; and a second engager disposed in the guide;

wherein the first engager is engageable with the second engager so as to prevent the guide from coming off of the apparatus at least in a direction to an external side of the apparatus, while the upper body portion is closed with respect to the lower body portion; and wherein the first engager is released from the second engager while the upper body portion is opened with respect to the lower body portion.

2. The apparatus according to claim 1, wherein the second engager is formed to protrude toward an external side of the apparatus from an external side surface of the guide.

3. The apparatus according to claim 2, wherein the first engager comprises an engaging protrusion which is located on an external side of the guide so as to prevent the guide from coming off of the apparatus at least in the direction to the external side of the apparatus, while the upper body portion is closed with respect to the lower body portion.

4. The apparatus according to claim 3, wherein the engaging protrusion has a first inclined surface which is inclined to the external side of the apparatus in a downward direction, and opposed to the guide while the upper body portion is closed with respect to the lower body portion.

5. The apparatus according to claim 4, wherein the guide has a second inclined surface corresponding to the first inclined surface, and the first inclined surface and the second inclined surface are opposed to each other while the upper body portion is closed with respect to the lower body portion.

6. The apparatus according to claim 1, wherein the first engager engages the second engager so as to inhibit a displacement of the guide in the direction to the external side of the apparatus as well as in an upward direction off the lower body portion while the upper body portion is closed with respect to the lower body portion.

7. The apparatus according to claim 1, wherein the guide has at least three supported portions which are spaced from one another in a horizontal direction, and the lower body portion has at least three supporting portions which respectively correspond to the supported portions and at which the lower body portion supports the guide.

8. The apparatus according to claim 7, wherein at least one of the supported portions is one of a shaft portion circular in cross section and a U-shaped cutout, which are disposed in a space defined inside the apparatus such that the shaft portion engages the cutout to be detachable therefrom in a direction and rotatable relatively thereto, and at least one of the supporting portions which corresponds to the at least one supported portion is the other of the shaft portion and the cutout.

9. The apparatus according to claim 8, wherein the first engager and the second engager are disposed at a position spaced from the shaft portion to be adjacent to or in contact with each other, so as to restrict at least rotation of the guide around an axis of the shaft portion and displacement of the guide in a direction to disengage the shaft portion from the cutout.

10. The apparatus according to claim 1, wherein a finger grip is disposed on an external surface of the guide to be held by a user when the guide is handled.

11. The apparatus according to claim 10, wherein the second engager is constituted by a rib formed on the external surface of the guide to extend parallel to a direction in which the recording medium is fed by being guided by the guide, and the finger grip is disposed on the rib.

12. The apparatus according to claim 1, wherein the upper body portion is attached to the lower body portion to be turnable around an axis substantially horizontal to be opened/closed with respect to the lower body portion.

13. The apparatus according to claim 1, wherein at least one of the fist engager and the second engager is formed by an elastic member which is fixed to a corresponding one of the upper body portion and the guide, and more easily deformable than the corresponding one, and the elastic member is brought into contact with the other of the first engager and the second engager and thereby compressed so as to inhibit displacement of the guide while the upper body portion is closed with respect to the lower body portion.

14. The apparatus according to claim 1, further comprising:

a rib formed on an external surface of the guide to extend parallel to a direction in which the recording medium is fed by being guided by the guide;

the second engager being constituted by an engager forming member formed of a sheet material folded in half to sandwich the rib with an inner surface of the sheet material fixed on opposite sides of the rib; and the first engager engaging the second engager so as to restrict displacement of the guide in the direction to the external side of the apparatus.

15. The apparatus according to claim 14, wherein the second engager has, at least at a distal end portion thereof, a shape extending parallel to a direction in which the upper body portion is moved at the moment the upper body portion is closed with respect to the lower body portion, and the distal end portion has an inclined surface which is inclined away from the second engager in a downward direction.

16. The apparatus according to claim 1, wherein the recording medium feeder comprises:

a feeder roller which picks up a topmost one of the stack of the recording media into the feed pathway; and a separator which is disposed at the upstream side of the guide, and separates the topmost recording medium picked up by the feeder roller, from the other recording media.

17. The apparatus according to claim 16, wherein the recording medium feeder further comprises:

a supply cassette accommodating the stack of the recording media; and an arm which is pivotable around a pivot axis parallel to a surface of the stack of the recording media, and holds the feeder roller at a position spaced from the pivot axis such that the feeder roller is rotatable.

18. The apparatus according to claim 1, wherein the upper body portion includes an image reading device.

19. The apparatus according to claim 1, wherein the second engager is fixed with respect to the guide.

20. The apparatus according to claim 1, wherein a width direction of the recording medium is perpendicular to a feeding direction of the recording medium; and wherein the upper portion is openable and closable relative to the lower body portion by being turned upward and downward around an axis which extends in a direction perpendicular to the width direction.

* * * * *

UNITED STATES PATENT AND TRADEMARK OFFICE

CERTIFICATE OF CORRECTION

PATENT NO. : 7,553,012 B2
APPLICATION NO. : 11/242794
DATED : June 30, 2009
INVENTOR(S) : Kozaki et al.

It is certified that error appears in the above-identified patent and that said Letters Patent is hereby corrected as shown below:

In Column 16, Claim 13, Line 6:
Please replace "fist engager" with --first engager--

Signed and Sealed this

Twenty-ninth Day of December, 2009

David J. Kappos

David J. Kappos
*Director of the United States Patent and Trademark Office*